United States Patent [19]
Caritato

[11] 3,949,392
[45] Apr. 6, 1976

[54] MULTI-ELEMENT DISPLAY APPARATUS FOR DISPLAYING DIFFERENT PATTERNS OR INFORMATION

[75] Inventor: Peter Caritato, Athens, Greece

[73] Assignee: Caritato Limited, Athens, Greece

[22] Filed: Oct. 29, 1974

[21] Appl. No.: 518,751

[30] Foreign Application Priority Data

Oct. 26, 1973 United Kingdom..... 50009/73

[52] U.S. Cl...... 340/336; 40/28 C
[51] Int. Cl.[2]..... G09F 9/32
[58] Field of Search..... 340/324 RM, 336, 378 R; 40/28 C, 33, 77, 52 R

[56] References Cited

UNITED STATES PATENTS

| | | | |
|---|---|---|---|
| 2,677,908 | 5/1954 | Clevinger et al. | 40/77 |
| 3,267,595 | 8/1966 | Levy et al. | 40/28 C |
| 3,307,170 | 2/1967 | Aoyama et al. | 340/324 M |
| 3,358,397 | 12/1967 | Rex | 40/77 |
| 3,410,011 | 11/1968 | Bowman | 40/28 C |

*Primary Examiner*—Marshall M. Curtis
*Attorney, Agent, or Firm*—Bosworth, Sessions & McCoy

[57] ABSTRACT

The present invention is a display apparatus having a display surface formed by an array of contiguous elements which are rotatable about vertical shafts to display a surface of contrasting appearance to the background appearance of the display surface thereby forming a mosaic displaying information. A column of solenoid operated actuator devices is driven along the back of the display surface and selected devices operate to rotate selected ones of the elements in each vertical shaft. The elements have a generally cubic overall shape with their vertical surfaces being cylindrically concave to allow rotation of an element without causing movement of a contiguous element. The bottom surfaces of the elements are grooved and arranged so as to co-operate with fixed horizontal members to provide an indexing arrangement. In addition, vertically extending channels communicate with the bore of each element to allow rain water to flow freely down the display surface. To assist the flow the top of the elements can have a frusto-conical recess.

24 Claims, 7 Drawing Figures

MULTI-ELEMENT DISPLAY APPARATUS FOR DISPLAYING DIFFERENT PATTERNS OR INFORMATION

BACKGROUND OF THE INVENTION

The present invention relates to display apparatus and more particularly to a display surface having an array of contiguous elements which are movable to present a surface of a contrasting appearance to the background appearance of the display surface thereby to display information.

Display apparatus is known which has an array of lights. The lights can be illuminated in any desired pattern to portray any given information. This apparatus however, is expensive to operate due to the fact that power is consumed and memory devices are used, (i.e. semiconductors, magnets, relays or ionization thresholds) to maintain the display of information and has the disadvantage that in bright sunlight the information may not be clearly seen. It was to avoid these disadvantages that displays having arrays of movable elements were proposed. However, many of the proposals were of limited application or complicated in operation and/or construction.

SUMMARY OF THE INVENTION

The present invention provides display apparatus comprising a display surface constituted by an array of contiguous elements each rotatable about the same or parallel axes and arranged in a formation of intersecting rows and columns, each element having a generally cubic overall shape and being mounted for individual rotation about an axis, each pair of opposite surfaces of each element lying in planes parallel to said axes presenting a visual effect which is contrastingly different from that presented by the other pair of opposite surfaces lying in planes parallel to said axes, and said surfaces of each element being cylindrically-concave in the direction of said axes; whereby any given element can be rotated without interacting with any contiguous element in order to position a selected surface of said given element so as to contribute to said display surface.

The apparatus described hereinafter has been produced to provide a display surface which gives the appearance of a continuous flat surface. It is preferred that the contrasting visual effect be produced by making alternate surfaces of the elements different colours. In this context, black and white are considered as colours and it is convenient to describe the invention in relation to each element displaying a black or a white face. However, it will be appreciated that other colours can be used as long as there are two faces of the elements which have contrasting appearances. Surfaces with differing reflective properties can also be used.

BRIEF DESCRIPTION OF THE DRAWINGS

Features and advantages of the present invention will become apparent from the following description of an embodiment thereof, given by way of example, with reference to the accompanying drawings, in which.

DESCRIPTION OF A PREFERRED EMBODIMENT

Briefly, the apparatus comprises an input unit in which the information to be displayed is scanned to produce the necessary signals for actuating selected ones of the array of elements of a display panel to display the information.

Figure 1:
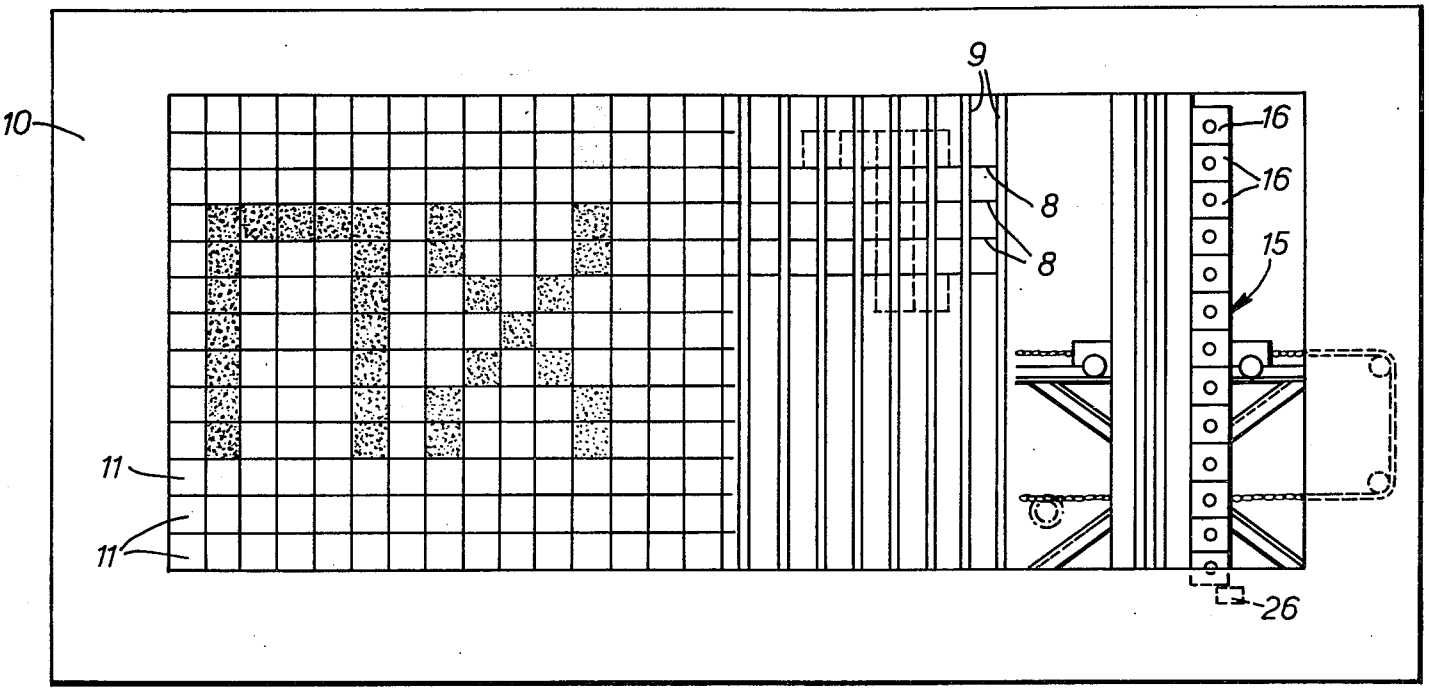
FIG. 1 is a front view of a display panel with parts broken away for clarity.

As shown in FIG. 1, the display panel 10 has a display surface constituted by an array of elements 11, each of which have a rectangular vertical cross-section and a horizontal cross-section of a regular four-sided figure with concave sides and are arranged in rows. Each element 11 has at least two contrastingly coloured surfaces and is rotatable about a column axis or shaft 9 to display to a viewer one of its vertical surfaces. The length of each shaft determines the height of the panel and the number of shafts determines the length of the panel. The elements are retained in position on the shafts by thin rods or wires 8 passing through the shafts 9.

Figure 2A:
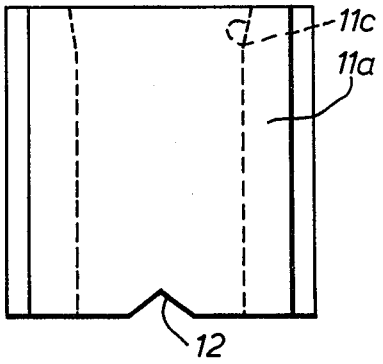
FIGS. 2A and 2B are side and plan views respectively of one type of element for use in the display panel of FIG. 1.
Figure 2B:
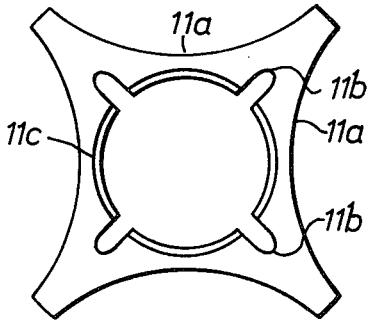

A typical element 11 is shown in FIGS. 2A and 2B from which it will be seen to be of generally cubic shape but with part-cylindrically recessed side surfaces 11A to allow for rotation of the elements. Opposite surfaces have the same colour. In addition, the vertical edges of the cube are rounded or angled to remove the right-angled corner so that they do not interfere with rotation of the element. Each element 11 is attached to a vertically disposed cylindrical shaft 9 and vertically located by one of the wires 8 being received in an inverted V-shaped recess 12 in the bottom of each face of the element 11. The element 11 is thus rotatable about the shaft and can be retained in any one of four positions by the wire 8 being received in the recesses 12.

The elements 11 are free to move up and down on the shafts 9 during rotation. This means that the camming action of the inverted V-shaped recesses in the elements 11 with the wires 8 is assisted by the weight of the elements to ensure that the elements are fully rotated to their correct position and maintained in that position. The weight of the elements is such as to ensure that small forces acting in the elements, for example vibration, will not cause rotation of the elements to an extent which would alter the display. The included angle of the inverted V-shaped recesses should be in the range 115°–125°, for example approximately 120°, but the preferred angle is 118°which although not giving the lowest thrust to displace the element gave the best compromise between low thrust and stability.

Since the display panel is likely to be exposed to the weather, drainage means are provided in the elements to allow rain water to run down the panel. If this is not done, there is a risk that over a period of time the dirt and grime carried in the rain will accumulate between the elements or between the elements and the shafts and cause jamming. The drainage means are shown in FIGS. 2A and 2B where it is seen that a plurality of vertically extending channels 11B are provided through each element, the channels opening into the central bore of the element. In addition the top of the bore of each element is counter-sunk to form a frusto-conical portion 11C which assists in causing the rain water to flow into the channels.

Figure 3A:
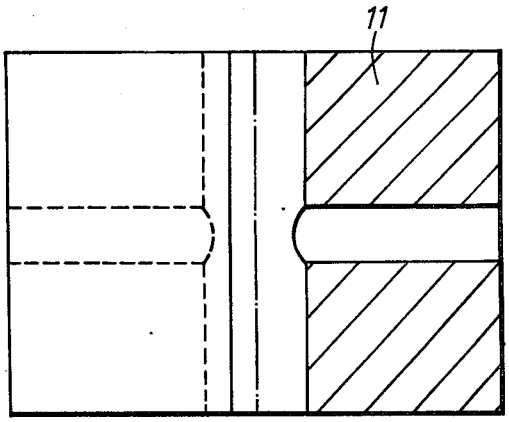
FIGS. 3A and 3B are plan and side views respectively of a further type of element for use in the display panel of FIG. 1.
Figure 3B:
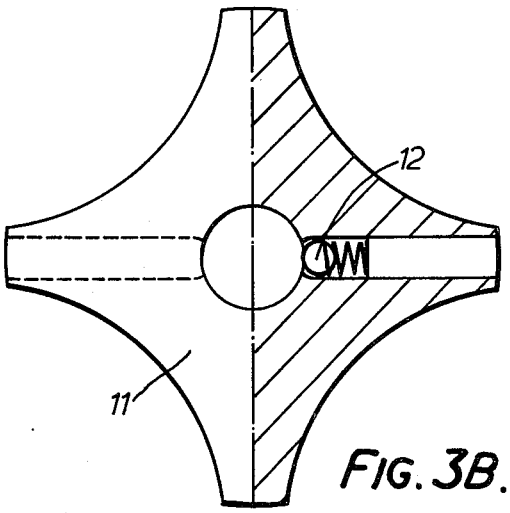

An alternative arrangement for locating the elements is shown in FIGS. 3A and 3B. In this case, each element is located by a spring loaded ball received in a circumferential groove in the shaft 9. The element 11 is thus rotatable about the shaft and can be retained in any desired position by a suitably positioned part-spherical recess (not shown) in the groove.

Instead of the elements being vertically located by a groove in the shaft, the elements can be retained by C-clips.

The overall shape of the elements 11 is not restricted to cubic forms; for instance elements having vertical surfaces of greater height than width can be used. What is important is that each element should be capable of displaying one of two contrasting surfaces, be movable without disturbing its neighbours, and the overall impression of the surface of the display panel should be that of a flat surface. This is achieved by using the above described elements; the shape of which allows the shafts to be mounted closer together than would otherwise be possible.

An actuator assembly 15 (FIG. 1) is provided behind the display panel 10 and comprises a column of electrically operable mechanical actuator units 16, one for each element in a column and therefore one for each row of elements of the matrix. The column of actuating assembly is mounted on a carriage which is driven across the back of the display panel and the units are operated sequentially to rotate the desired elements on a shaft in accordance with the signals produced by the input unit so as to display the necessary information.

The column of actuator units can be driven in a stepwise manner or the column of actuators can be driven smoothly and continuously across the back of the display panel. In either case it is necessary to provide synchronisation means on the panel to cause actuation of the column of actuators at the correct moment to displace the required elements. The synchronisation means will be described in more detail later.

Figures 4, 5:
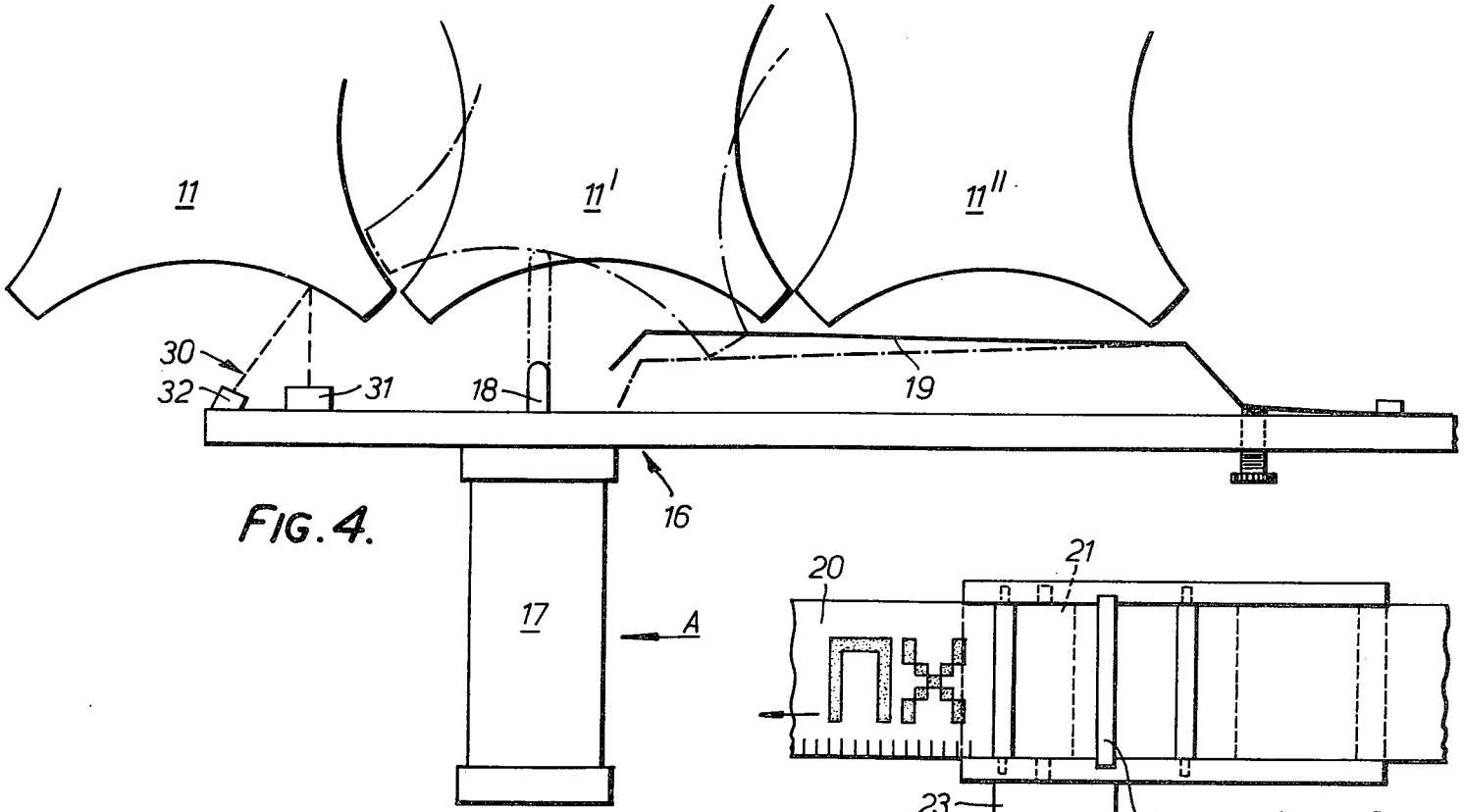
FIG. 4 is a diagrammatic plan view showing the operation of the elements of the display panel of FIG. 1.
FIG. 5 is a plan view of a part of an apparatus for use with the display panel of FIG. 1.

The operation of an actuator unit 16 will be more clearly understood from the following description of FIG. 4. In this FIG., a row of three elements 11, 11' and 11'' are shown. Behind the row of elements there is positioned an actuator unit 16 which is adapted to move in the direction of the arrow A. The actuator unit 16 comprises an electromagnetic device, preferably a spring loaded solenoid 17, energization of which causes actuator member 18 to be pushed forward into engagement with an element 11.

A resilient member in the form of a leaf spring 19 also forms part of the actuator unit and its purpose will be explained later.

Assume that elements 11' and 11'' already display the correct surface either because they have been acted upon by the actuator unit 16 or because they already displayed the correct surface. Further assume that it is necessary to rotate the element 11 so that it will display the correct surface.

With the actuator in the position shown in full lines in the drawing, a signal from the input unit is fed to the solenoid 17 to cause the actuator member 18 to assume the position shown in broken lines. This causes the element 11' to rotate slightly and brings one corner into contact with the leaf spring 19. The actuator assembly 15 is then moved in the direction of the arrow A which causes a slight further rotation of the element 11' in the same direction as previously against the action of the spring 19 until the element 11' assumes the position shown in broken lines where the operating arm moves off the element 11' and into contact with the projecting edge of the element 11. Further movement of the actuator unit 16 in the direction of arrow A causes rotation of the element 11 through approximately 90°while the element 11' is returned to its position in which it displays the desired surface due to the action of the spring 19 which is sufficiently long, in this case, 1½ cube widths long but preferably 3–5 cubes widths long, to prevent rotation of the element 11'' should the element 11' touch it.

It is not necessary that the actuator member 18 rotate the element through fully 90°since the weight of the element and the inverted V-shaped recesses will ensure that the element completes its rotation through 90°. In addition, the leading end of the spring 19 is bent in a direction away from the elements to form a cam surface which can be used to urge the partly rotated element fully through the 90°rotation as the actuator unit 16 moves.

The input unit is shown in more detail in FIG. 5. The information to be displayed is provided on a backing sheet 20, preferably of paper, which is drawn through the unit over a platen in a step wise manner by a drive roller 21 and co-operating pressure roller 22. The drive roller 21 is driven in a step wise manner by an actuating device in the form of a geared motor or of a solenoid 23 which co-operates with the teeth of a ratchet wheel attached to the roller 21. Each angular step of the roller 21 causes the sheet 20 to be stepped past a sensing head 25 by a distance corresponding to the distance between the axes of two adjacent columns of elements in the display panel 10 or a sub multiple of this distance. In order to ensure correct tensioning of the sheet, it is threaded around feed rollers. The preferred drive arrangement is a modified chart recorder mechanism. Operation of the motor or solenoid is controlled by a signal obtained from a timing track on the sheet.

The sensing head 25 comprises a row of photoelectric devices (not shown) one for each element in a column and one for the timing track on the sheet. The sheet is illuminated and the output of the photoelectric devices indicates whether or not a black or a white face should be shown by the elements of the display panel and provides the appropriate switching inputs to the actuator units. The movement of the sheet past the sensing head 25 is synchronised with movement of the actuator assembly past the elements of the display device to give a one-to-one translation of the information on the sheet by comparing the outputs from the additional photocell in the input unit with the output from an additional photoelectric device 26 on the actuator device 15 which views an illuminated timing track on the display panel.

In order to ensure correct functioning of the display panel, a further device 30 is preferably associated with each actuator 16 for sensing the surface displayed by the element to be rotated by the actuator and only if the signal provided by this further actuator is different from the signal produced by the corresponding photoelectric device in the sensing head 25 is the actuator operated to rotate the element.

The further device 30 is preferably a light source 31 and a photocell 32 mounted on each actuator 16. The output from the photocell 32 is compared with the corresponding desired output from the input unit in display logic units having an EXCLUSIVE-OR gate where if the inputs to the gate differ then and only then will a signal be fed to the actuator 16 to cause rotation of the element. With this arrangement it is possible to use shift registers to transfer the data from the input unit serially to shift registers which will present it to the display logic units.

The fact that opposite surfaces of the element are of the same colour allows the simple logic described above to be used and also allows the actuator device to be as simple to operate as possible since the elements can be rotated in the same direction to display alternatively coloured surfaces.

I claim:

1. Display apparatus comprising a plurality of vertically mounted parallel shafts, a plurality of elements rotatably mounted on each of said shafts, an array of contiguous elements arranged in a formation of intersecting rows and columns to form a display surface, each element having a rectangular vertical cross-section, the horizontal cross-section being that of a regular four-sided figure with concave sides to form four display surfaces each lying in a plane parallel to said column axes and each display surface being cylindrically concave in the direction of said axes, each pair of opposite display surfaces presenting a visual effect which is contrastingly different from that presented by the other pair of opposite surfaces lying in planes parallel to said column axes, actuating means for rotating a given element to position a selected surface of said given element so as to contribute to said display surface, indexing means for retaining said given element in a rotated position, and drive means for moving said actuating means with respect to the array of elements to enable sequential rotation of selected elements.

2. Display apparatus according to claim 1, further comprising means for retaining the elements in rotated positions displaying the selected surface.

3. Display apparatus according to claim 2, wherein said retaining means comprises recesses in the bottom surfaces of the elements which are arranged to receive projections extending transversely from the shafts when the element is in a rotated position.

4. Display apparatus according to claim 3, wherein the recesses are inverted V-shaped recesses.

5. Display apparatus according to claim 3, wherein said projections are constituted by rods extending between said shafts.

6. Display apparatus according to claim 1, wherein each element is provided a bore for receiving a shaft with at least one channel extending parallel to the axis of the bore in the element and opening into said bore.

7. Display apparatus according to claim 6, wherein the top of the bore of each element is provided with a portion of larger diameter than the bore to form an inwardly converging frusto-conical portion whereby fluid on the top of the element tends to flow into the bore and thence into at least one channel.

8. Display apparatus according to claim 1, wherein the array of elements forms a rectangular matrix, and wherein the actuating means comprises a plurality of actuator units, one for each element on a shaft.

9. Display apparatus according to claim 8, wherein each actuator unit comprises a solenoid, energisation of which causes movement of an actuator member.

10. Display apparatus according to claim 8, wherein each actuator unit further comprises resilient means arranged to control the free rotation of an element immediately preceding an element to be rotated.

11. Display apparatus according to claim 1, further comprising input means for supplying to the actuating means signals indicative of information to be displayed.

12. Display apparatus according to claim 11, wherein said information supplying means comprises means for scanning information to be displayed in a number of steps equal to the number of rows or columns in the array of elements.

13. Display apparatus according to claim 12, wherein said scanning means comprises a plurality of photoelectric devices, the number of which corresponds to the number of actuator units.

14. Display apparatus according to claim 12, further including means for synchronising operation of said drive means with operation of said scanning means.

15. Display apparatus according to claim 1, further comprising means mounted on said actuating means for identifying the visual effect of the surface displayed by an element.

16. Display apparatus according to claim 15, wherein said identifying means comprises an optical device adapted to produce an output indicative of the surface displayed.

17. In a display apparatus comprising a plurality of vertically mounted parallel shafts, a plurality of elements rotatably mounted on each of said shafts, a display surface formed by an array of contiguous elements arranged in a formation of intersecting rows and columns, actuating means for rotating a given element to position a selected surface of said given element so as to contribute to said display surface and drive means for moving said actuating means with respect to the array of elements to enable sequential rotation of selected elements, the improvement comprising each element having a rectangular vertical cross-section, the horizontal cross-section being that of a regular four-sided figure, and each pair of opposite surfaces of the element lying in planes parallel to said column axes presenting a visual effect which is contrastingly different from that presented by the other pair of opposite surfaces lying in planes parallel to said column axes, and indexing means for retaining said given element in a rotated position, said indexing means comprising projecting means extending transversely from said shafts and means defining recesses in the bottom surface of each element for receiving said projecting means.

18. Display apparatus according to claim 17, wherein the recess defining means defines a recess of inverted V-shape.

19. Display apparatus according to claim 18, wherein the included angle of the inverted V-shaped recesses is between 115° and 125°.

20. Display apparatus according to claim 17, wherein said included angle is 118°.

21. Display apparatus according to claim 17, wherein said projecting means are constituted by wires extending between said shafts.

22. Display apparatus according to claim 17, wherein said element surfaces lying in planes parallel to the column axes are cylindrically concave in the direction of said axes, whereby any element can be rotated without interacting with any contiguous element.

23. Display apparatus according to claim 17, wherein each element has a central bore for mounting the element on a shaft, and at least one channel extending parallel to the bore and opening into the bore.

24. Display apparatus according to claim 23, wherein the top of the bore of each element is provided with a portion of larger diameter than the bore to form an inwardly converging frusto-conical portion whereby fluid on the top of the element tends to flow into the bore and thence into at least one channel.

* * * * *